US010803777B1

(12) United States Patent
Moody

(10) Patent No.: US 10,803,777 B1
(45) Date of Patent: Oct. 13, 2020

(54) APPARATUS AND METHODS FOR MOUNTING A POSTER

(71) Applicant: Scott C. Moody, Auburn, AL (US)

(72) Inventor: Scott C. Moody, Auburn, AL (US)

( * ) Notice: Subject to any disclaimer, the term of this patent is extended or adjusted under 35 U.S.C. 154(b) by 0 days.

(21) Appl. No.: 16/390,259

(22) Filed: Apr. 22, 2019

Related U.S. Application Data

(60) Provisional application No. 62/661,332, filed on Apr. 23, 2018.

(51) Int. Cl.

| | |
|---|---|
| ***A47G 1/06*** | (2006.01) |
| ***G09F 15/00*** | (2006.01) |
| ***G09F 15/02*** | (2006.01) |
| ***A47G 1/16*** | (2006.01) |

(52) U.S. Cl.
CPC ..... *G09F 15/0018* (2013.01); *A47G 1/0638* (2013.01); *A47G 1/162* (2013.01); *G09F 15/02* (2013.01); *A47G 2001/0677* (2013.01); *A47G 2001/0688* (2013.01)

(58) Field of Classification Search
CPC ... G09F 15/0018; G09F 15/02; A47G 1/0638; A47G 1/162; A47G 2001/0688; A47G 2001/0677; A47G 1/20; A47G 1/22
USPC ..... 248/216.1, 217.3; 40/757–759, 792; 24/67.3
See application file for complete search history.

(56) References Cited

U.S. PATENT DOCUMENTS 2,651,129 A * 9/1953 Spertus ..... A47G 1/14 40/749
3,665,628 A * 5/1972 Dammond ..... A47G 1/0638 40/792
3,924,307 A * 12/1975 Tate ..... A47G 1/0638 24/543
3,965,601 A * 6/1976 Nielsen ..... A47G 1/0605 40/782
3,996,682 A * 12/1976 Schwartz ..... A47G 1/0605 40/794
4,089,129 A 5/1978 Patterson, Jr.
4,216,597 A * 8/1980 Kocina ..... A47G 1/0605 248/496
4,356,647 A 11/1982 Farris
4,641,441 A * 2/1987 Roth ..... A47G 1/1626 40/792

(Continued)

FOREIGN PATENT DOCUMENTS

CA 2198199 A1 8/1998

*Primary Examiner* — Cassandra Davis

(74) *Attorney, Agent, or Firm* — Bush Intellectual Property Law; Kenneth M. Bush

(57) ABSTRACT

A poster mounting system is disclosed herein that, in various aspects, includes a slot disposed in a top rail and a poster insertably received in the slot. A clip may be insertably received within the slot to secure the poster. The clip, in various aspects, is formed as a unitary longitudinal member divided into a first segment and a second segment with an apex between the first segment and the second segment defining an obtuse angle with respect to the first segment and the second segment. When positioned in the slot, portions of the clip are compressively biased against a side face of the slot and other portions of the clip are compressively biased against portions of the poster to frictionally compressively engage the portions of the poster against an opposing side wall, in various aspects. The clips are removable to allow disengagement of the poster, in various aspects.

6 Claims, 5 Drawing Sheets

(56) References Cited

U.S. PATENT DOCUMENTS

| | | | | | |
|---|---|---|---|---|---|
| 4,773,545 | A | * | 9/1988 | Jones | A47G 1/21<br>211/45 |
| 4,805,325 | A | * | 2/1989 | Cassard | A47G 1/142<br>40/759 |
| D312,205 | S | * | 11/1990 | de Rooij | 40/759 |
| 5,588,629 | A | * | 12/1996 | Barnes | A47F 5/08<br>248/217.3 |
| 5,863,019 | A | | 1/1999 | Rose et al. | |
| D424,120 | S | | 5/2000 | Wear | |
| 7,146,687 | B2 | * | 12/2006 | Kaim | B42F 9/00<br>24/67.3 |
| 2011/0210219 | A1 | | 9/2011 | Pedersen | |
| 2017/0203605 | A1 | | 7/2017 | Pedersen | |

* cited by examiner

APPARATUS AND METHODS FOR MOUNTING A POSTER

CROSS-REFERENCE TO RELATED APPLICATIONS

The present application claims priority to U.S. Provisional Patent Application No. 62/661,332 filed Apr. 23, 2018, which is hereby incorporated by reference in its entirety herein.

FIELD OF THE INVENTION

The present disclosure relates to displays, and, more particularly, apparatus and related methods for mounting a poster for display.

BACKGROUND OF THE INVENTION

It is known to mount a poster to a top rail and a bottom rail and to then secure the top rail to a wall in order to display the poster. Various poster mounting devices include a top rail made of two pieces and bottom rail also made of two pieces. Such poster mounting devices may use either screws or magnets in order to clamp the two pieces of the top rail together and to clamp the two pieces of the bottom rail together with the poster interposed between the two pieces of the top rail and the bottom rail thereby securing the poster between the two pieces.

However, the use of screws and the use of magnets has certain drawbacks. For example, when screws are used to clamp the two pieces of the top rail and the two pieces of the bottom rail together, the screws may pass through the poster, which damages the poster and may prevent reuse of the poster. It is difficult to manufacture the top rail and the bottom rail that includes magnets. Unless the magnets are of a rare earth variety, the magnets may lack sufficient clamping force to hold the poster securely between the two pieces of the top rail and the two pieces of the bottom rail.

In yet other poster mounting devices, the top rail and the bottom rail each include a channel having a geometry formed to secure the poster when the poster is inserted into the channel. However, such geometry may be difficult to manufacture and may not be achievable with certain materials such as wood.

In addition, poster mounting devices may use a cord system for hanging the top rail. The cord is necessary because rails cannot be hung with typical picture frame hanging hardware. Rails hung with typical picture frame hanging hardware exhibit a tilt away from the wall because of a moment (torque) exerted on the top rail by the suspension of the poster and bottom rail from the top rail. The resulting tilt detracts from the overall esthetic appearance. While the cords prevent such tilt, the cords may detract from the esthetics by creating competing lines that complicate the presentation.

Accordingly, there is a need for improved poster mounting systems as well as related methods for mounting a poster between a top rail and a bottom rail.

BRIEF SUMMARY OF THE INVENTION

These and other needs and disadvantages may be overcome by the apparatus and related methods disclosed herein. Additional improvements and advantages may be recognized by those of ordinary skill in the art upon study of the present disclosure.

In various aspects, a poster mounting system disclosed herein includes a slot disposed in a top rail and a poster insertably received in the slot. A clip may be insertably received within the slot to secure the poster. The clip, in various aspects, is formed as a unitary longitudinal member divided into a first segment and a second segment with an apex between the first segment and the second segment that defines an obtuse angle with respect to the first segment and the second segment. The clip is positioned in the slot by insertion of an end of the second segment to compressively bias the end of the second segment and portions of the first segment against a side face of the slot and to compressively bias the apex against a portion of the poster in order to bias compressively the portion of the poster against an opposing side face of the slot, in various aspects. The clip and the portion of the poster are thusly frictionally compressively engaged with the side wall and the opposing side wall, in various aspects. Following insertion, the clip may be rotated within the slot about the apex to increase the frictional compressive engagement. Multiple clips may be inserted into a top rail and into a bottom rail to secure the poster to the top rail and to the bottom rail, in various aspects. The clips may be extracted and then the poster may be removed from engagement. Related methods of use are disclosed herein.

This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

Figure 1:
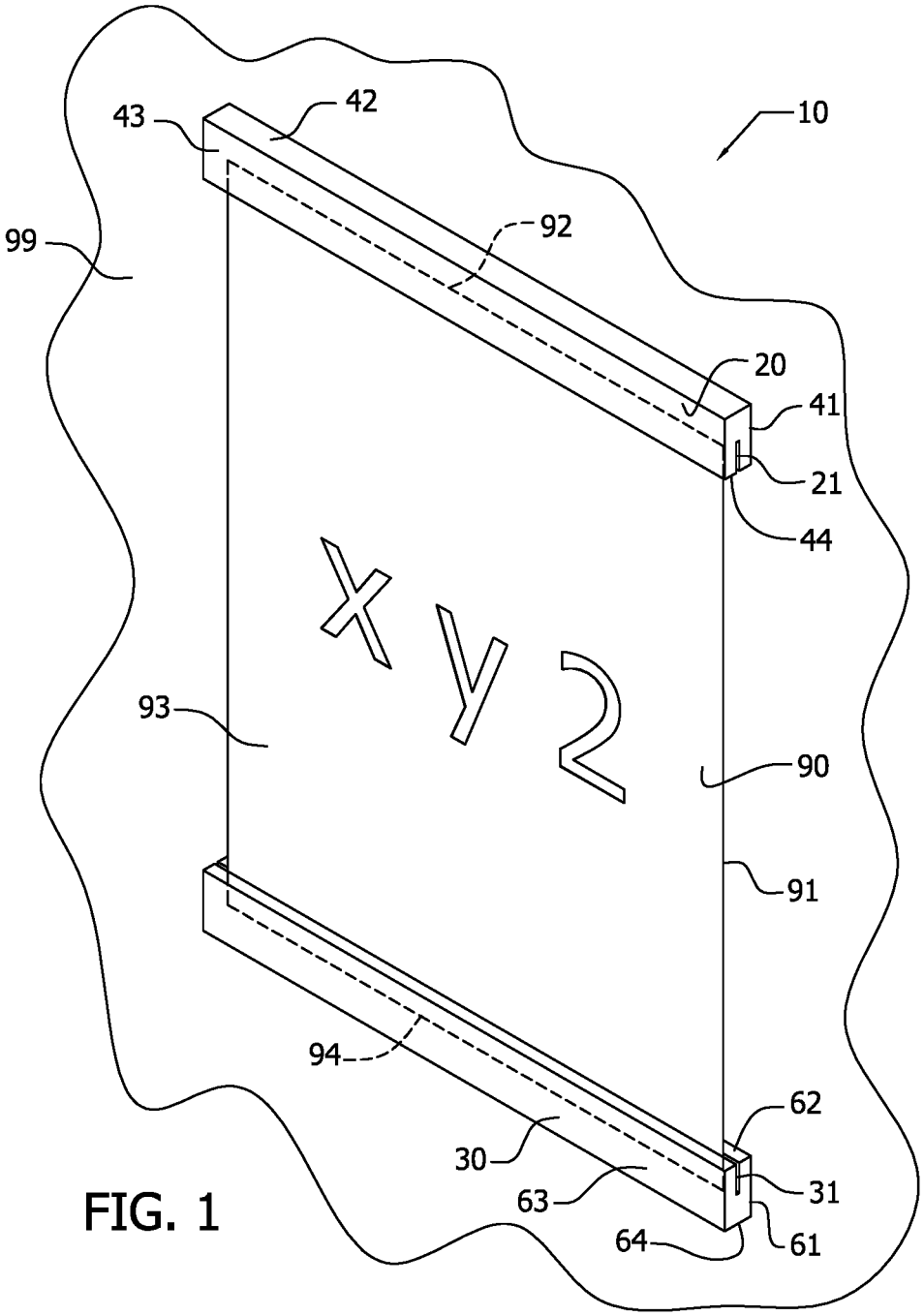
FIG. 1 illustrates by perspective view an exemplary implementation of a poster mounting system.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances such as ±0.1%, ±1%, ±2.5%, ±5%, or other such tolerances, as would be readily recognized by those of ordinary skill in the art upon study of this disclosure.

DETAILED DESCRIPTION OF THE INVENTION

In various aspects, a poster mounting system that includes a plurality of clips is disclosed herein. Each clip of the plurality of clips may be formed as a unitary longitudinal member divided into a first segment and a second segment with an apex between the first segment and the second segment that defines an obtuse angle with respect to the first segment and the second segment. In various aspects, each clip of the plurality of clips may be positioned in a slot by insertion of an end of the second segment to compressively bias the end of the second segment and portions of the first segment against a side face of the slot to correspondingly compressively bias the apex against a portion of a poster received in the slot. The apex biases compressively the portion of the poster against an opposing side face of the slot thereby frictionally compressively engaging each clip and the portion of the poster with the side wall and the opposing side wall, in various aspects.

FIG. 1 illustrates exemplary poster mounting system 10 including poster 90 positioned between top rail 20 and bottom rail 30 with poster 90 secured to top rail 20 and poster 90 secured to bottom rail 30. Top rail 20 is illustrated as attached to wall 99 including various generally vertical structure, for example, using bracket 80 (see FIG. 6A), and top rail 20 is positioned superior to bottom rail 30. In this implementation, top rail 20 has top face 42 oriented upward, bottom face 44 oriented downward, front face 43 oriented outward, and back face 41 oriented toward wall 99. Similarly, bottom rail 30 has top face 62 oriented upward, bottom face 64 oriented downward, front face 63 oriented outward, and back face 61 oriented toward wall 99, in this implementation.

As illustrated in FIG. 1, slot 21 is formed in bottom face 44 of top rail 20, and portions of poster 90 proximate poster end 92 are securably removably retained in slot 21 of top rail 20 to engage releasably poster 90 with top rail 20. Slot 31 is formed in top face 62 of bottom rail 30, as illustrated, and portions of poster 90 proximate poster end 94 are securably removably retained in slot 31 of bottom rail 30 to engage releasably poster 90 with bottom rail 30. A number of clips, such as clip 50*a*, 50*b*, 50*c*, 50*d* (see FIGS. 3A, 3B, 4C, 4D, 5A, 5B) are insertably removably received in slots 21, 31 along with portions of poster 90 to releasably engage poster 90 with top rail 20 and bottom rail 30, respectively. Poster side 93 of poster 90 is oriented outward to be visible to a viewer, as illustrated. Poster side 93 forms a display surface that, for example, displays an image, text, or an image in combination with text, in this implementation. Poster side 91 is oriented toward wall 99 and is generally not visible to the viewer, as illustrated. The bottom rail 30 may be omitted, in certain other implementations. Some implementations may include additional rails formed similar to top rail 20 and bottom rail 30 positioned along vertical sides of poster 90 so that poster 90 is entirely framed.

Top rail 20 and bottom rail 30 may be composed of wood, various hard plastics, metal, other material, or combinations of materials, as would be readily recognizable by those of ordinary skill in the art upon study of this disclosure. As used herein, "poster" may be a poster, a picture, a placard, a sign, various types of artwork, and the like, and poster 90 may be composed of fabric such as canvas or burlap, paper, metal such as sheet steel or sheet aluminum, plastic, or various combinations thereof, as would be readily recognizable by those of ordinary skill in the art upon study of this disclosure.

Figure 2A:
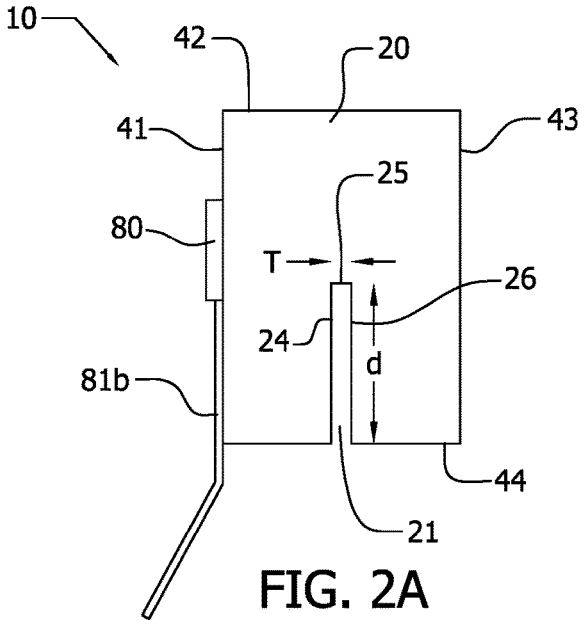
FIG. 2A illustrates by end view portions of the exemplary poster mounting system of FIG. 1.
Figure 2B:
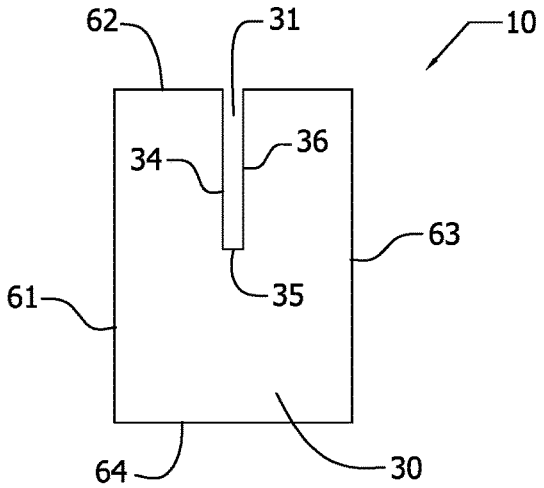
FIG. 2B illustrates by end view portions of the exemplary poster mounting system of FIG. 1.

FIGS. 2A and 2B illustrate top rail 20 with slot 21 formed in bottom face 44 and bottom rail 30 with slot 31 formed in top face 62, respectively. In this implementation, slots 21, 31 extend the entire length of bottom face 44 of top rail 20 and the entire length of top face 62 of bottom rail 30, respectively. In other implementations, slots 21, 31 may extend only a portion of the lengths of bottom face 44 of top rail 20 and top face 62 of bottom rail 30, respectively, with, for example, a length of slots 21, 31 corresponding to a width of poster 90.

Slot 21 defines side faces 24, 26 and end face 25, and slot 31 defines side faces 34, 36, and end face 35, as illustrated in FIGS. 2A, 2B. For example, side faces 24, 26 of slot 21 may have depth d of about ¾ inch, end face 25 of slot 21 may have a width T of about 3/32 inch, and slot 31 may be sized similarly to slot 21, in various implementations. Slots 21, 31 may be formed in top rail 20 and bottom rail 30, respectively, by various machining operations. As illustrated in FIG. 2A, top rail 20 includes mounting bracket 80 and arms 81*a*, 81*b* (see FIGS. 6A, 6B) that allow attachment of top rail 20 including poster 90 and bottom rail 30 to a wall. Arms 81*a*, 81*b* prevent rotation of top rail 20 when top rail 20 is attached to the wall by bracket 80 and poster 90 and bottom rail 30 are suspended from top rail 20, in this implementation.

Figure 3A:
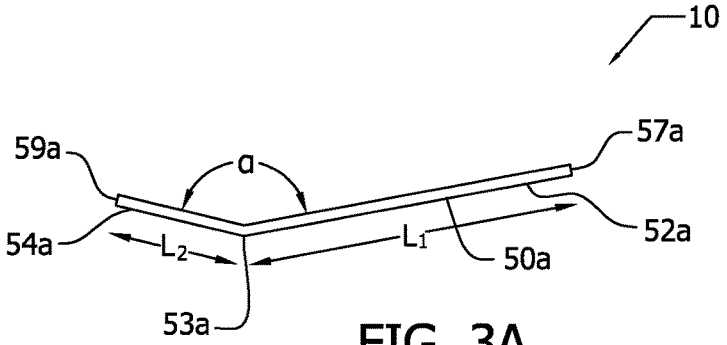
FIG. 3A illustrates by side view portions of the exemplary poster mounting system of FIG. 1.
Figure 3B:
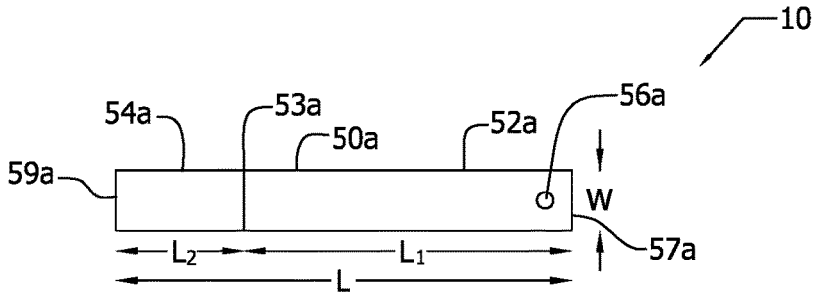
FIG. 3B illustrates by top view portions of the exemplary poster mounting system of FIG. 1.

FIGS. 3A and 3B illustrate clip 50*a*, and it should be understood that clips 50*b*, 50*c*, 50*d* are similar in form and function to clip 50*a*. As illustrated in FIG. 3A, clip 50*a* is formed as a unitary longitudinal member having a rectangular cross-section. Clip 50*a*, in this implementation, includes segment 52*a* and segment 54*a* joined at apex 53*a* with segments 52*a*, 54*a* being generally straight and defining angle $\alpha$ with respect to one another. Hole 56*a* located proximate end 57*a* of clip 50*a* acts as an indicator that indicates that clip 50*a* is in the fourth stage of deployment 18 described below (see FIGS. 4D, 5B), and may provide some texture that enhances the ability of a user to grip clip 50*a*. In certain implementations, hole 56*a* may be omitted. Clip 50*a* may be composed of, for example, spring steel or other metallic or plastic material(s) that are elastically deformable. Clip 50*a* may be formed, for example, by stamping, bending, or injection molding depending upon the material of clip 50*a*.

As illustrated in FIGS. 3A, 3B, clip 50*a* has width W and length L between clip ends 57*a*, 59*a*. Segment 52*a* has length $L_1$ from end 57*a* to apex 53*a*, and segment 54*a* has length $L_2$ from clip end 59*a* to apex 53*a*. In various implementations, for example, length $L_2$ may be about ⅛ of the length L of clip 50*a*. In one exemplary implementation, width W is about 0.25 inch and length L is about 2 inches so that length $L_1$ of segment 52*a* is about 1.75 inch and length $L_2$ of segment 54*a* is about 0.25 inch. Angle α may be about 160°, for example, in certain implementations. In certain implementations, angle α may fall generally within a range of from about 160° to about 120°, in various implementations, so that angle α is obtuse as is the conjugate of angle α.

FIGS. 4A, 4B, 4C, 4D illustrate exemplary sequential first stage of deployment 12, second stage of deployment 14, third stage of deployment 16, and fourth stage of deployment 18, of poster mounting system 10. FIGS. 5A, 5B also illustrate third stage of deployment 16 and fourth stage of deployment 18 of poster mounting system 10, respectively. Poster 90 may be secured to top rail 20 and secured to bottom rail 30 by sequentially progressing through first stage of deployment 12, second stage of deployment 14, third stage of deployment 16, and fourth stage of deployment 18. The progression through first stage of deployment 12, second stage of deployment 14, third stage of deployment 16, and fourth stage of deployment 18 is generally uninterrupted and nearly immediate. For example, positioning of a clip, such as clip 50*a*, 50*c*, through first stage of deployment 12, second stage of deployment 14, third stage of deployment 16, and fourth stage of deployment 18 may be accomplished within about 1-2 seconds. The mounting of poster 90 may be completed by mounting top rail 20 to wall 99 using mounting bracket 80 following fourth stage of deployment 18. The top rail 20 may be removed from wall 99 and the sequence first stage of deployment 12, second stage of deployment 14, third stage of deployment 16, and fourth stage of deployment 18, reversed to remove poster 90 from top rail 20 and from bottom rail 30.

Figure 4A:
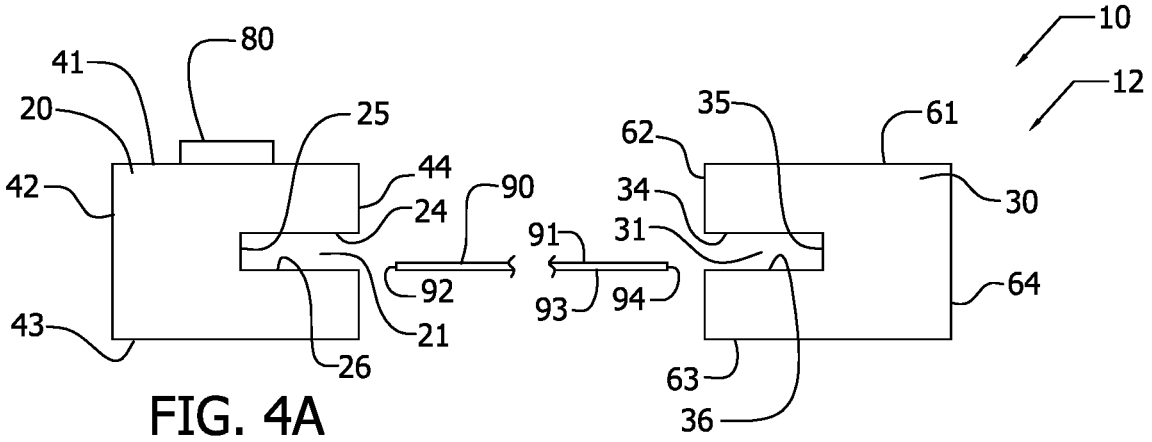
FIG. 4A illustrates by cut-away side view portions of the exemplary poster mounting system of FIG. 1 at an exemplary first stage of deployment.
Figure 5A:
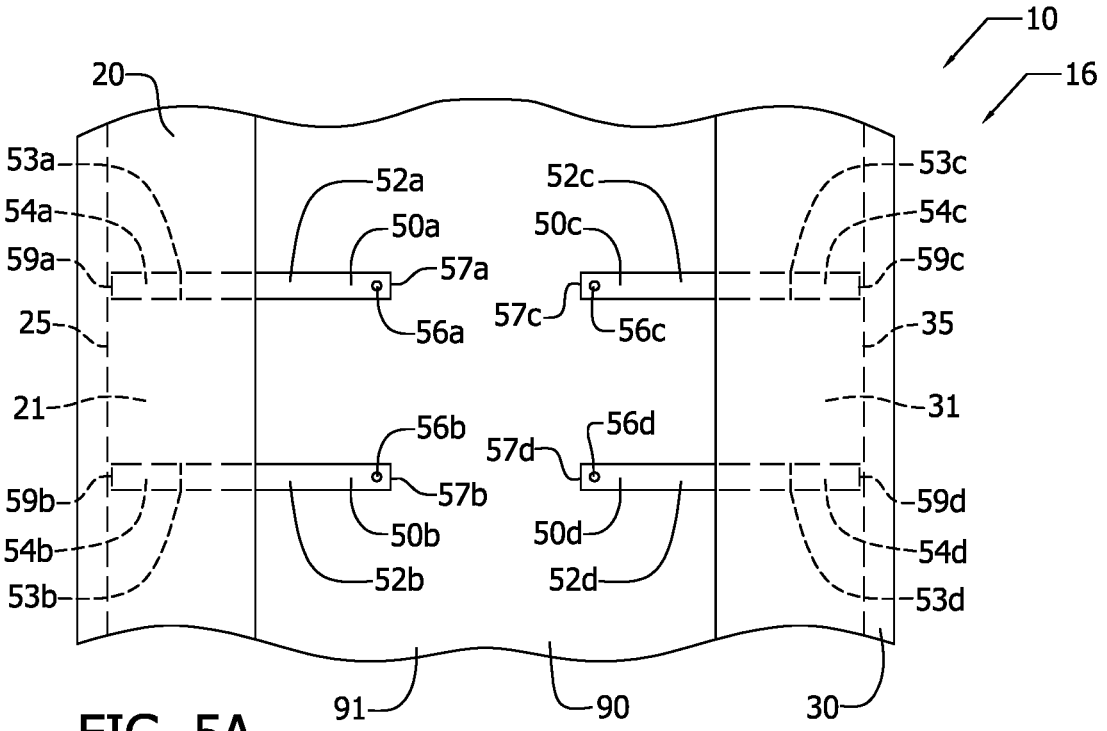
FIG. 5A illustrates by top view portions of the exemplary poster mounting system of FIG. 1 at the exemplary third stage of deployment.
Figure 5B:
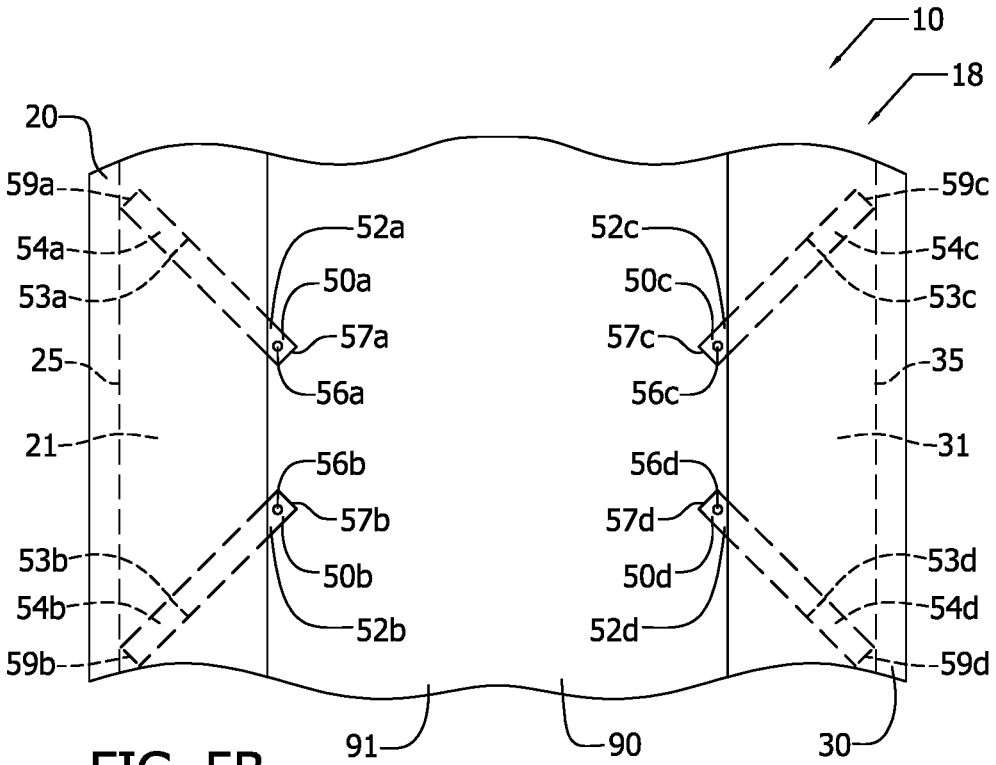
FIG. 5B illustrates by top view portions of the exemplary poster mounting system of FIG. 1 at the exemplary fourth stage of deployment.

At first stage of deployment 12, as illustrated in FIG. 4A, top rail 20 and bottom rail 30 are positioned proximate poster ends 92, 94, respectively, of poster 90. Slots 21, 31 are generally in parallel alignment with poster ends 92, 94 for insertion of poster ends 92, 94 into slots 21, 31, respectively. Poster 90 is oriented so that poster side 93 that forms the display surface has the same orientation as front faces 43, 63 of rails 20, 30, respectively, as illustrated. Poster side 91 has the same orientation as back faces 41, 61 of rails 20, 30, respectively, as illustrated.

Figure 4B:
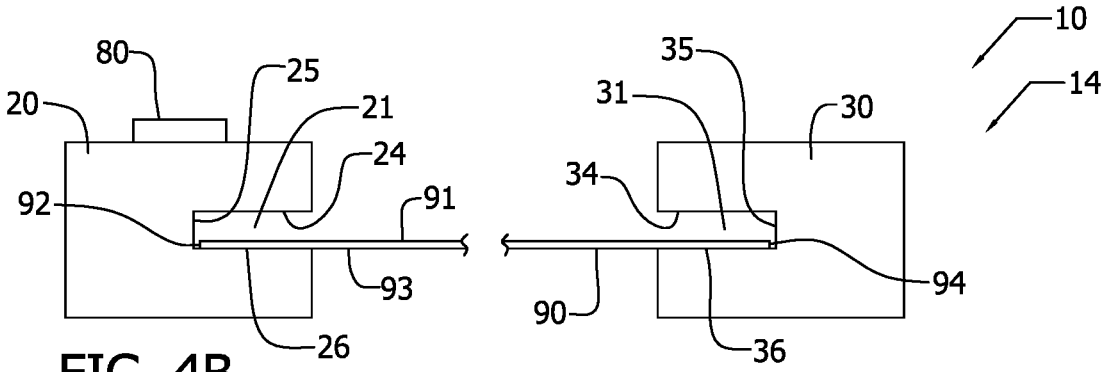
FIG. 4B illustrates by cut-away side view portions of the exemplary poster mounting system of FIG. 1 at an exemplary second stage of deployment.

At second stage of deployment 14, as illustrated in FIG. 4B, poster ends 92, 94 are insertably received in slots 21, 31, respectively. Poster ends 92, 94 may be inserted in slots 21, 31 generally to depth d so that poster ends 92, 94 contact end faces 25, 35, respectively. Note that poster side 93 is biased against side faces 26, 36 of slots 21, 31, respectively, as illustrated.

Figure 4C:
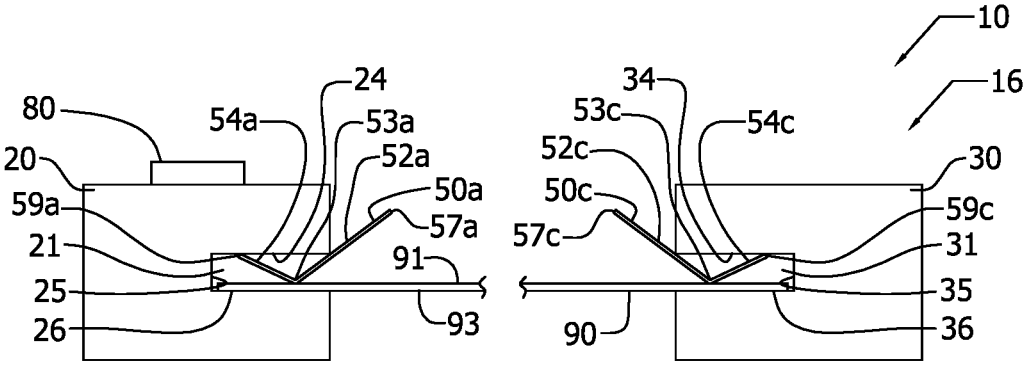
FIG. 4C illustrates by cut-away side view portions of the exemplary poster mounting system of FIG. 1 at an exemplary third stage of deployment.

At third stage of deployment 16, as illustrated in FIG. 4C, clips 50*a*, 50*c* are insertably received in slots 21, 31, respectively. In order to position clips 50*a*, 50*c* in stage of deployment 16, clip ends 59*a*, 59*c* are inserted manually generally to depth din slots 21, 31, respectively, so that clip ends 59*a*, 59*c* are positioned proximate end faces 25, 35, respectively, and clip ends 59*a*, 59*c* may bias against end faces 25, 35. As clips 50*a*, 50*c* are inserted to depth d in slots 21, 31, angle α causes clip ends 59*a*, 59*c* and portions of segments 52*a*, 52*c* to bias against faces 24, 34 of slots 21, 31, respectively, and apexes 53*a*, 53*c* to bias against poster side 91 of poster 90, in turn, to bias poster side 93 of poster 90 against faces 26, 36 thereby causing clips 50*a*, 50*c* to flex elastically. As clips 50*a*, 50*c* flex elastically, angle α increases, and the resultant elastic forces in clips 50*a*, 50*c* compressionably bias poster 90 between apexes 53*a*, 53*c* and faces 26, 36, respectively, and compressionably bias clip ends 59*a*, 59*c* and portions of segments 52*a*, 52*c* bias against faces 24, 34. Clips 50*a*, 50*c* are frictionally secured within slots 21, 31 by the compressive biasment of clip ends 59*a*, 59*c* and portions of segments 52*a*, 52*c* against faces 24, 34 and the compressive biasment of apexes 53*a*, 53*c* against poster 90 that, in turn, compressively biases poster 90 against faces 26, 36 of slots 21, 31 to secure frictionally poster 90 in slots 21, 31, respectively. In certain implementations, clips 50*a*, 50*c* may be only minimally compressively biased or may be free within slots 21, 31, respectively, at third stage of deployment 16 to allow removal of clips 50*a*, 50*c* from slots 21, 31 when clips 50*a*, 50*c* are at third stage of deployment 16.

Figure 4D:
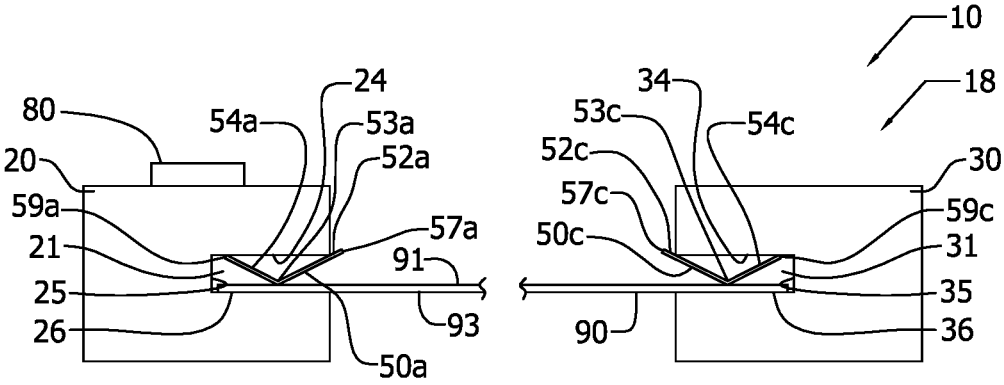
FIG. 4D illustrates by cut-away side view portions of the exemplary poster mounting system of FIG. 1 at an exemplary fourth stage of deployment.

At fourth stage of deployment 18, as illustrated in FIG. 4D, clips 50*a*, 50*c* are rotated about apexes 53*a*, 53*c* manually to increase the portions of segments 52*a*, 52*c* biased against faces 24, 34, respectively, in order to increase the elastic flexure of clips 50*a*, 50*c*. Portions of segments 52*a*, 52*c* proximate ends 57*a*, 57*c* including holes 56*a*, 56*c* extend forth sufficiently from slots 21, 31 to allow a user to manipulate clips 50*a*, 50*c*, for example, to extract clips 50*a*, 50*c*. Clips 50*a*, 50*c* and poster 90 are completely secured after rotation at fourth stage of deployment 18, and clips 50*a*, 50*c* are not readily removable from slots 21, 31 in fourth stage of deployment 18, in this implementation.

FIG. 5A, further illustrates third stage of deployment 16, and FIG. 5B further illustrates fourth stage of deployment 18 including portions of poster 90 secured to portions of rails 20, 30. As illustrated in FIG. 5A, clips 50*a*, 50*b* are compressively frictionally secured within slot 21 of top rail 20 to secure poster 90, at least in part, to top rail 20, and clips 50*c*, 50*d* are compressively frictionally secured within slot 31 of bottom rail 30 to secure poster 90, at least in part, to bottom rail 30.

As illustrated in FIG. 5A, clips 50*a*, 50*b* are inserted into slot 21 so that clip ends 59*a*, 59*b* are generally proximate end face 25 of slot 21, segments 54*a*, 54*b* are within slot 21, and apexes 53*a*, 53*b* bias compressively against poster side 91 of poster 90 to frictionally compressively secure portions of poster 90 within slot 21 of top rail 20. Thus, as illustrated, poster side 91 proximate poster end 92 is frictionally compressively engaged with apexes 53*a*, 53*b*, and poster side 93 proximate poster end 92 is frictionally biased against side face 26 to frictionally compressively secure poster 90 to top rail 20. Note that clips 50*a*, 50*b*, 50*c*, 50*d* are generally perpendicular to top rail 20 and bottom rail 30 at third stage of deployment 16, as illustrated in FIG. 5A. Also note that portions of segments 52*a*, 52*b* proximate ends 57*a*, 57*b* including holes 56*a*, 56*b*, respectively, extend forth from slot 21 and portions of segments 52*c*, 52*d* proximate ends 57*c*, 57*d* including holes 56*c*, 56*d*, respectively, extend forth from slot 31 at third stage of deployment 16, as illustrated.

As illustrated in FIG. 5A, clips 50*c*, 50*d* are inserted into slot 31 so that clip ends 59*c*, 59*d* are generally proximate end face 35 of slot 31, segments 54*c*, 54*d* are within slot 31, and apexes 53*c*, 53*d* bias compressively against poster side 91 of poster 90 to frictionally compressively secure portions of poster 90 within slot 31 of bottom rail 30, as illustrated.

Thus, poster side 91 proximate poster end 94 is frictionally compressively engaged with apexes 53*c*, 53*d*, and poster side 93 proximate poster end 94 is frictionally biased against side face 36 to frictionally compressively secure poster 90 to bottom rail 30.

Poster mounting system is positioned from third stage of deployment 16 into fourth stage of deployment 18 by rotating clips 50*a*, 50*b*, 50*c*, 50*d* about apexes 53*a*, 53*b*, 53*c*, 53*d*, in this implementation. Clips 50*a*, 50*b* and clips 50*c*, 50*d* are rotated from being generally perpendicular to top rail 20 and bottom rail 30, respectively, at third stage of deployment 16 illustrated in FIG. 5A, to being slanted with respect to top rail 20 and bottom rail 30 at fourth stage of deployment 18 illustrated in FIG. 5B. As illustrated in FIG. 5B clips 50*a*, 50*b* and clips 50*c*, 50*d* may be variously slanted with respect to top rail 20 and bottom rail 30, respectively, at fourth stage of deployment 18 by being variously rotated either clockwise or counterclockwise from the perpendicular. At fourth stage of deployment 18, the portions of segments 52*a*, 52*b* biased against face 24 and the portions of segments 52*c*, 52*d* biased against face 34 are increased thereby increasing the elastic flexure of clips 50*a*, 50*b*, 50*c*, 50*d* to increase the compressive forces in clips 50*a*, 50*b*, 50*c*, 50*d* thereby increasing the compressive frictional securement of poster 90 to top rail 20 and to bottom rail 30. Accordingly, the rotation of clips 50*a*, 50*b*, 50*c*, 50*d* at fourth stage of deployment 18 may increase the compressive frictional securement of poster 90 to top rail 20 and to bottom rail 30 in comparison with the compressive frictional securement of poster 90 to top rail 20 and to bottom rail 30 at third stage of deployment 16. Note that portions of segments 52*a*, 52*b*, 52*c*, 52*d* proximate ends 57*a*, 57*b*, 57*c*, 57*d* including holes 56*a*, 56*b*, 56*c*, 56*d* extend forth sufficiently from slots 21, 31 to allow the user to manipulate clips 50*a*, 50*b*, 50*c*, 50*d* at fourth stage of deployment 18, as illustrated in FIG. 5B. When holes 56*a*, 56*b*, 56*c*, 56*d* are only slightly exposed with respect to top rail 20 and bottom rail 30, as illustrated, clips 50*a*, 50*b*, 50*c*, 50*d* are generally at fourth stage of deployment 18.

It should be recognized that clips 50*a*, 50*b*, 50*c*, 50*d* are illustrative for purposes of explanation, and that various numbers of clips, such as clips 50*a*, 50*b*, 50*c*, 50*d*, may be used to secure poster 90 to top rail 20 and to bottom rail 30, and the clips may be positioned about slots 21, 31 of top rail 20 and bottom rail 30, respectively, in various ways, in various implementations.

The user may manipulate clips 50*a*, 50*b*, 50*c*, 50*d* at fourth stage of deployment 18 in order to remove clips 50*a*, 50*b*, 50*c*, 50*d*. For example, clips 50*a*, 50*b* may be rotated by the user from being generally slanted with respect to top rail 20 to being perpendicular with respect to top rail 20, and clips 50*c*, 50*d* may be rotated by the user from being generally slanted with respect to bottom rail 30 to being perpendicular with respect to bottom rail 30. That is, clips 50*a*, 50*b*, 50*c*, 50*d* are repositioned by the user from fourth stage of deployment 18 to third stage of deployment 16. With clips 50*a*, 50*b*, 50*c*, 50*d* at third stage of deployment 16, the user may then extract clips 50*a*, 50*b*, 50*c*, 50*d* from slots 21, 31 thereby releasing poster 90 from top rail 20 and bottom rail 30. The removal of poster 90 from top rail 20 and bottom rail 30 may be nearly immediate.

Figure 6A:
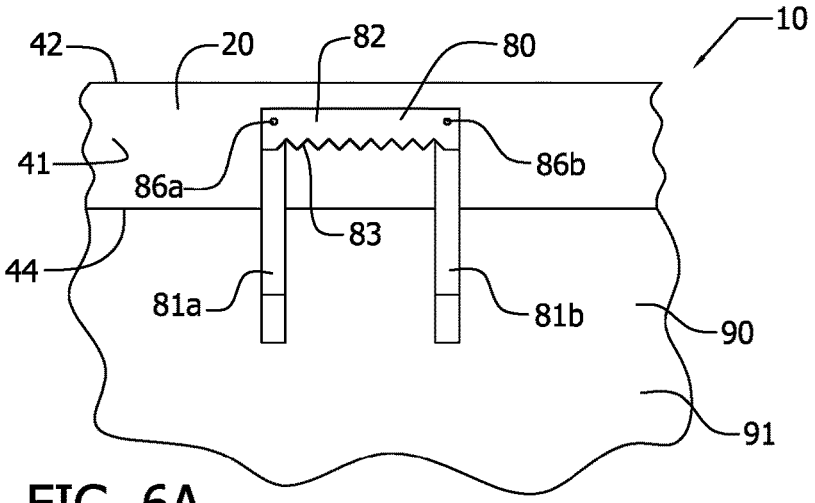
FIG. 6A illustrates by back elevation view portions of the exemplary poster mounting system of FIG. 1.
Figure 6B:
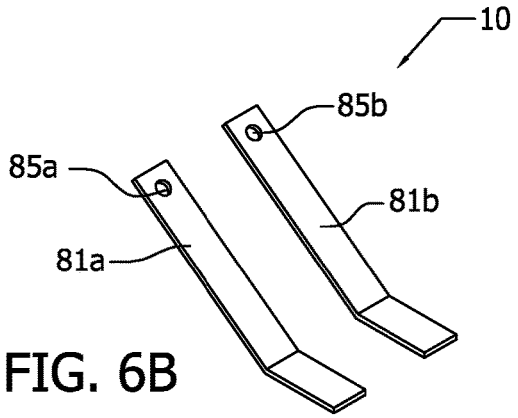
FIG. 6B illustrates by perspective view portions of the exemplary poster mounting system of FIG. 1.

FIGS. 6A, 6B and FIG. 2A illustrate mounting bracket 80 that includes support 82 and arms 81*a*, 81*b* secured to back face 41 of top rail 20 by fasteners 86*a*, 86*b*. Fasteners 86*a*, 86*b* may be, for example, screws or nails. In this implementation, support 82 is offset from back face 41 of top rail 20 to allow mounting of top rail 20 to wall 99 by toothed engagement of teeth 83 with a fastener (not shown) such as a nail, hook, or screw protrudingly received in wall 99. Arms 81*a*, 81*b* located at ends of support 82, in this implementation, extend past bottom face 44 of top rail 20 behind poster side 91 of poster 92 to bias against wall 99 when mounting bracket 80 is mounted to wall 99. The biasing of at least portions of arms 81*a*, 81*b* against wall 99 prevents rotation of top rail 20 due to the moment on top rail 20 created by the weight of poster 92 and bottom rail 30 suspended from top rail 20, so that back face 41 lies generally flat against wall 99 and top face 44 has a generally horizontal orientation. Arms 81*a*, 81*b* may be generally similar to clips 50*a*, 50*b*, 50*c*, 50*d*, in some implementations, as illustrated in FIG. 6B. In other implementations, arms 81*a*, 81*b* may be generally straight. Arms 81*a*, 81*b* may be secured to back face 41 of top rail 20 concurrent with support 82 using fasteners 86*a*, 86*b* passed through holes 85*a*, 85*b* in arms 81*a*, 81*b* respectively, corresponding holes in support 82, and received in top rail 20, as illustrated.

Figure 7A:
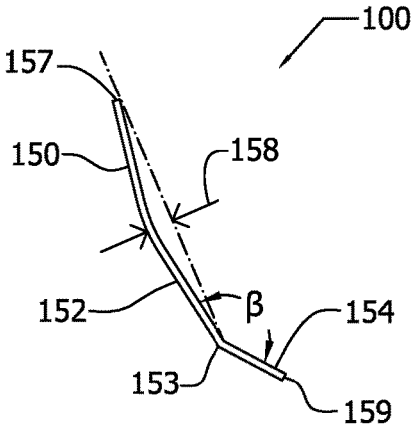
FIG. 7A illustrates by side view portions of another exemplary implementation of a poster mounting system; and, FIG. 7B illustrates by plan view portions of the exemplary poster mounting system of FIG. 7A.
Figure 7B:
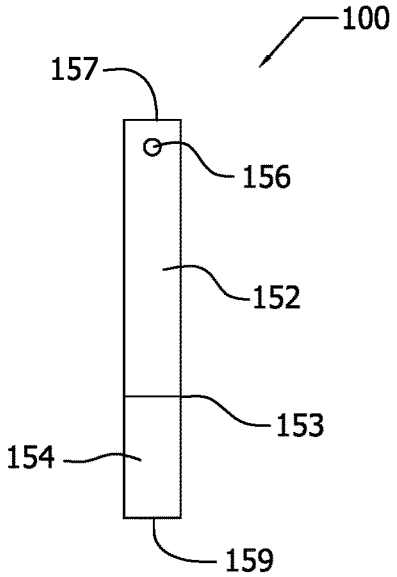

FIGS. 7A, 7B illustrate portions of exemplary poster mounting system 100 including clip 150. As illustrated in FIGS. 7A, 7B, clip 150 is a unitary structure formed into segment 152 and segment 154 joined at apex 153 with segments 152, 154 defining angle β with respect to one another at apex 153. Hole 156 located proximate clip end 157 of clip 150 may make clip 150 proximate clip end 157 grippable by the user. Note that segment 154 of clip 150 is generally linear, while segment 152 of clip 150 is curved thus having camber 158, as illustrated. Clip end 159 of clip 150 may be inserted into a slot, such as slot 21, 31, to secure a poster, such as poster 90, within the slot in a manner similar to that of clips 50*a*, 50*b*, 50*c*, 50*d*. For example, the sequential first stage of deployment 12, second stage of deployment 14, third stage of deployment 16, and fourth stage of deployment 18, illustrated in FIGS. 4A, 4B, 4C, 4D may be implemented using several clips such as clip 150 in lieu of clips 50*a*, 50*b*, 50*c*, 50*d*.

The foregoing discussion along with the Figures discloses and describes various exemplary implementations. These implementations are not meant to limit the scope of coverage, but, instead, to assist in understanding the context of the language used in this specification and in the claims. The Abstract is presented to meet requirements of 37 C.F.R. § 1.72(b) only. This Abstract is not intended to identify key elements of the apparatus and methods disclosed herein or to delineate the scope thereof. Upon study of this disclosure and the exemplary implementations herein, one of ordinary skill in the art may readily recognize that various changes, modifications and variations can be made thereto without departing from the spirit and scope of the inventions as described herein and as defined in the following claims.

The invention claimed is:

1. A method of mounting a poster, comprising the steps of:

a) providing a poster having a poster top end, a poster bottom end, and opposing poster sides;

b) providing a poster mounting system comprising a top rail having a top rail bottom face with an elongated top rail slot formed therein, a bottom rail having a bottom rail top face with an elongated bottom rail slot formed therein, and a plurality of resilient securing clips;

wherein the top rail slot comprises a top rail slot upper end, a top rail slot front face, and a top rail slot rear face;

wherein the bottom rail slot comprises a bottom rail slot lower end, a bottom rail slot front face, and a bottom rail slot rear face; and wherein each securing clip comprises a unitary longitudinal member having a first segment having a first end, a second segment having a second end, and an apex between the first segment and the second segment that defines an obtuse angle with respect to the first segment and the second segment;

c) inserting the poster top end into the top rail slot until the poster top end is adjacent the top rail slot upper end;

d) inserting a first securing clip into the top rail slot until the first securing clip first end is adjacent the top rail slot upper end, the first securing clip first segment and the first securing clip apex are fully within the top rail slot, and the first securing clip second segment partially extends out of the top rail slot;

wherein the first securing clip first end forcibly engages the top rail slot rear face and the first securing clip apex forcibly engages the poster top end when the first securing clip first segment and the first securing clip apex are fully within the top rail slot; and wherein the first securing clip apex forcibly biases the poster top end against the top rail slot front face to frictionally attach the poster top end to the top rail when the first securing clip first segment and the first securing clip apex are fully within the top rail slot;

e) gripping the first securing clip second end and rotating the first securing clip about the first securing clip apex to increase an elastic flexure of the first securing clip and thereby increase a compressive force of the first securing clip against the top rail slot rear face and the poster top end to frictionally secure the poster top end to the top rail, wherein the first securing clip second end extends out of the top rail slot after this step is completed;

f) inserting a second securing clip into the top rail slot in a spaced relationship relative to the first securing clip until the second securing clip first end is adjacent the top rail slot upper end, the second securing clip first segment and the second securing clip apex are fully within the top rail slot, and the second securing clip second segment partially extends out of the top rail slot;

wherein the second securing clip first end forcibly engages the top rail slot rear face and the second securing clip apex forcibly engages the poster top end when the second securing clip first segment and the second securing clip apex are fully within the top rail slot; and wherein the second securing clip apex forcibly biases the poster top end against the top rail slot front face to frictionally attach the poster top end to the top rail when the second securing clip first segment and the second securing clip apex are fully within the top rail slot;

g) gripping the second securing clip second end and rotating the second securing clip about the second securing clip apex to increase an elastic flexure of the second securing clip and thereby increase a compressive force of the second securing clip against the top rail slot rear face and the poster top end to frictionally secure the poster top end to the top rail, wherein the second securing clip second end extends out of the top rail slot after this step is completed;

h) inserting the poster bottom end into the bottom rail slot until the poster bottom end is adjacent the bottom rail slot lower end;

i) inserting a third securing clip into the bottom rail slot until the third securing clip first end is adjacent the bottom rail slot lower end, the third securing clip first segment and the third securing clip apex are fully within the bottom rail slot, and the third securing clip second segment partially extends out of the bottom rail slot;

wherein the third securing clip first end forcibly engages the bottom rail slot rear face and the third securing clip apex forcibly engages the poster bottom end when the third securing clip first segment and the third securing clip apex are fully within the bottom rail slot; and wherein the third securing clip apex forcibly biases the poster bottom end against the bottom rail slot front face to frictionally attach the poster bottom end to the bottom rail when the third securing clip first segment and the third securing clip apex are fully within the bottom rail slot;

j) gripping the third securing clip second end and rotating the third securing clip about the third securing clip apex to increase an elastic flexure of the third securing clip and thereby increase a compressive force of the third securing clip against the bottom rail slot rear face and the poster bottom end to frictionally secure the poster bottom end to the bottom rail, wherein the third securing clip second end extends out of the bottom rail slot after this step is completed;

k) inserting a fourth securing clip into the bottom rail slot in a spaced relationship relative to the third securing clip until the fourth securing clip first end is adjacent the bottom rail slot lower end, the fourth securing clip first segment and the fourth securing clip apex are fully within the bottom rail slot, and the fourth securing clip second segment partially extends out of the bottom rail slot;

wherein the fourth securing clip first end forcibly engages the bottom rail slot rear face and the fourth securing clip apex forcibly engages the poster bottom end when the fourth securing clip first segment and the fourth securing clip apex are fully within the bottom rail slot; and wherein the fourth securing clip apex forcibly biases the poster bottom end against the bottom rail slot front face to frictionally attach the poster bottom end to the bottom rail when the fourth securing clip first segment and the fourth securing clip apex are fully within the bottom rail slot;

l) gripping the fourth securing clip second end and rotating the fourth securing clip about the fourth securing clip apex to increase an elastic flexure of the fourth securing clip and thereby increase a compressive force of the fourth securing clip against the bottom rail slot rear face and the poster bottom end to frictionally secure the poster bottom end to the bottom rail, wherein the fourth securing clip second end extends out of the bottom rail slot after this step is completed; and m) securing the top rail to a support structure to display the poster, wherein the top rail is operable to secure the poster to the support structure, wherein the bottom rail is operable to maintain the poster taut, and wherein the poster sides are fully exposed.

2. The method of claim 1, wherein the top rail includes a mounting bracket attached to a top rail rear face, the mounting bracket having two pivotable arms extending outwardly from the top rail, the arms operable to engage the support structure when pivoted into a vertical orientation and thereby prevent rotation of the top rail relative to the support structure.

3. A method of mounting a poster, comprising the steps of:

a) providing a poster having a poster top end, a poster bottom end, and opposing poster sides;

b) providing a poster mounting system comprising a top rail having a top rail bottom face with an elongated top rail slot formed therein and a plurality of resilient securing clips;

wherein the top rail slot comprises a top rail slot upper end, a top rail slot front face, and a top rail slot rear face; and wherein each securing clip comprises a unitary longitudinal member having a first segment having a first end, a second segment having a second end, and an apex between the first segment and the second segment that defines an obtuse angle with respect to the first segment and the second segment;

c) inserting the poster top end into the top rail slot until the poster top end is adjacent the top rail slot upper end;

d) inserting a first securing clip into the top rail slot until the first securing clip first end is adjacent the top rail slot upper end, the first securing clip first segment and the first securing clip apex are fully within the top rail slot, and the first securing clip second segment partially extends out of the top rail slot;

wherein the first securing clip first end forcibly engages the top rail slot rear face and the first securing clip apex forcibly engages the poster top end when the first securing clip first segment and the first securing clip apex are fully within the top rail slot; and wherein the first securing clip apex forcibly biases the poster top end against the top rail slot front face to frictionally attach the poster top end to the top rail when the first securing clip first segment and the first securing clip apex are fully within the top rail slot;

e) gripping the first securing clip second end and rotating the first securing clip about the first securing clip apex to increase an elastic flexure of the first securing clip and thereby increase e a compressive force of the first securing clip against the top rail slot rear face and the poster top end to frictionally secure the poster top end to the top rail, wherein the first securing clip second end extends out of the top rail slot after this step is completed;

f) inserting a second securing clip into the top rail slot in a spaced relationship relative to the first securing clip until the second securing clip first end is adjacent the top rail slot upper end, the second securing clip first segment and the second securing clip apex are fully within the top rail slot, and the second securing clip second segment partially extends out of the top rail slot;

wherein the second securing clip first end forcibly engages the top rail slot rear face and the second securing clip apex forcibly engages the poster top end when the second securing clip first segment and the second securing clip apex are fully within the top rail slot; and wherein the second securing clip apex forcibly biases the poster top end against the top rail slot front face to frictionally attach the poster top end to the top rail when the second securing clip first segment and the second securing clip apex are fully within the top rail slot;

g) gripping the second securing clip second end and rotating the second securing clip about the second securing clip apex to increase an elastic flexure of the second securing clip and thereby increase a compressive force of the second securing clip against the top rail slot rear face and the poster top end to frictionally secure the poster top end to the top rail, wherein the second securing clip second end extends out of the top rail slot after this step is completed; and h) securing the top rail to a support structure to display the poster, wherein the top rail is operable to secure the poster to the support structure, and wherein the poster sides are fully exposed.

4. The method of claim 3, wherein the top rail includes a mounting bracket attached to a top rail rear face, the mounting bracket having two pivotable arms extending outwardly from the top rail, the arms operable to engage the support structure when pivoted into a vertical orientation and thereby prevent rotation of the top rail relative to the support structure.

5. The method of claim 3, wherein the poster mounting system further comprises a bottom rail having a bottom rail top face with an elongated bottom rail slot formed therein, wherein the bottom rail slot comprises a bottom rail slot lower end, a bottom rail slot front face, and a bottom rail slot rear face.

6. The method of claim 5, further comprising the steps of:

i) inserting the poster bottom end into the bottom rail slot until the poster bottom end is adjacent the bottom rail slot lower end;

j) inserting a third securing clip into the bottom rail slot until the third securing clip first end is adjacent the bottom rail slot lower end, the third securing clip first segment and the third securing clip apex are fully within the bottom rail slot, and the third securing clip second segment partially extends out of the bottom rail slot;

wherein the third securing clip first end forcibly engages the bottom rail slot rear face and the third securing clip apex forcibly engages the poster bottom end when the third securing clip first segment and the third securing clip apex are fully within the bottom rail slot; and wherein the third securing clip apex forcibly biases the poster bottom end against the bottom rail slot front face to frictionally attach the poster bottom end to the bottom rail when the third securing clip first segment and the third securing clip apex are fully within the bottom rail slot;

k) gripping the third securing clip second end and rotating the third securing clip about the third securing clip apex to increase an elastic flexure of the third securing clip and thereby increase a compressive force of the third securing clip against the bottom rail slot rear face and the poster bottom end to frictionally secure the poster bottom end to the bottom rail, wherein the third securing clip second end extends out of the bottom rail slot after this step is completed;

l) inserting a fourth securing clip into the bottom rail slot in a spaced relationship relative to the third securing clip until the fourth securing clip first end is adjacent the bottom rail slot lower end, the fourth securing clip first segment and the fourth securing clip apex are fully within the bottom rail slot, and the fourth securing clip second segment partially extends out of the bottom rail slot;

wherein the fourth securing clip first end forcibly engages the bottom rail slot rear face and the fourth securing clip apex forcibly engages the poster bottom end when the fourth securing clip first segment and the fourth securing clip apex are fully within the bottom rail slot; and wherein the fourth securing clip apex forcibly biases the poster bottom end against the bottom rail slot front face to frictionally attach the poster bottom end to the bottom rail when the fourth securing clip first segment and the fourth securing clip apex are fully within the bottom rail slot; and m) gripping the fourth securing clip second end and rotating the fourth securing clip about the fourth securing clip apex to increase an elastic flexure of the fourth securing clip and thereby increase a compressive force of the fourth securing clip against the bottom rail slot rear face and the poster bottom end to frictionally secure the poster bottom end to the bottom rail, wherein the fourth securing clip second end extends out of the bottom rail slot after this step is completed.

* * * * *